United States Patent [19]

Pezold

[11] Patent Number: 4,575,704

[45] Date of Patent: Mar. 11, 1986

[54] ELECTRICAL ADAPTOR

[75] Inventor: Arthur J. Pezold, Redding, Calif.

[73] Assignee: Fire Savr, Redding, Calif.

[21] Appl. No.: 693,789

[22] Filed: Jan. 23, 1985

Related U.S. Application Data

[63] Continuation-in-part of Ser. No. 574,548, Jan. 27, 1984, abandoned.

[51] Int. Cl.[4] ..... H01H 85/02

[52] U.S. Cl. ..... 337/197; 339/147 R

[58] Field of Search ..... 337/197, 198, 209; 339/147 R, 147 P, 159 R, 159 C

[56] References Cited

U.S. PATENT DOCUMENTS 2,636,096 4/1953 Di Blasi ..... 339/159

2,988,617 6/1961 Graziosi ..... 337/197

*Primary Examiner*—Harold Broome

*Attorney, Agent, or Firm*—Fitch, Even, Tabin & Flannery

[57] ABSTRACT

An adaptor is described for an electrical AC wall socket for providing a fused link between the wall socket and an electrical appliance or the like. The adaptor includes a male plug extending from a housing for mating with the wall socket for providing electrical connection therewith. A female plug is provided in the housing and is linked to the male plug by at least one fuse. The fuse or fuses are mounted on the housing by plug-in connectors to permit the fuses to be readily removed and replaced. Each of the fuses is contained in its own housing and is visible therein through a transparent window. The fuse housings are accommodated in recesses in the adaptor housing.

11 Claims, 3 Drawing Figures

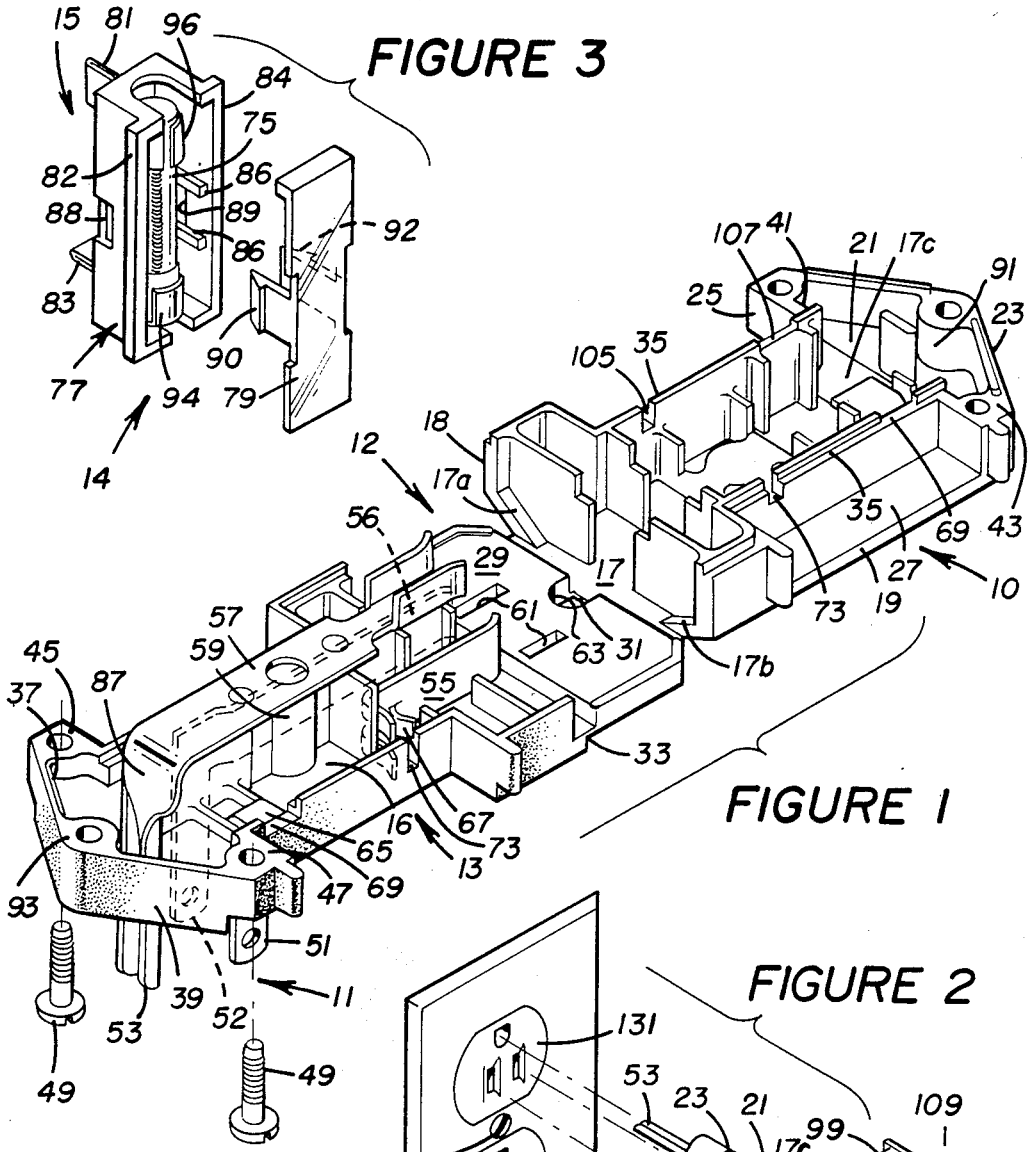
FIGURE 3
FIGURE 1
15
81
96
84
75
82
86
88
89
86
92
83
77
90
94
79
14
107
41
21
17c
91
25
23
105
35
18
12
17a
56
29
17
61
63
31
17b
35
69
43
27
10
73
19
57
59
45
87
37
55
33
16
67
73
65
13
69
47
93
51
11
39
52
53
49
49
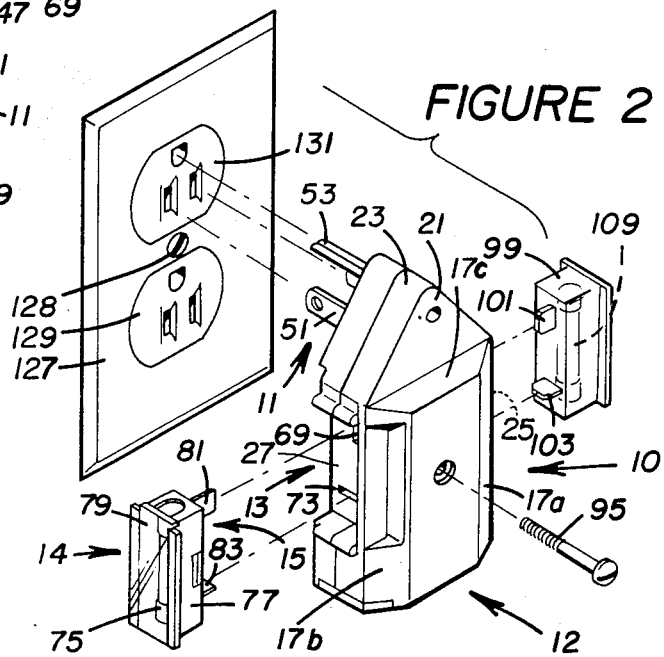
FIGURE 2
131
53
23
21
109
99
17c
128
101
129
51
127
11
25
103
69
27
10
81
13
73
17a
95
79
15
14
83
77
75
17b
12

ELECTRICAL ADAPTOR

This application is a continuation-in-part of application Ser. No. 574,548 filed Jan. 27, 1984 and now abandoned.

This invention relates generally to electrical connecting devices and, more particularly, to an adaptor for an electrical AC wall socket for providing a fused link between the wall socket and an electrical appliance or the like.

Circuit breakers, fuses, and similar safety devices are included in the typical household circuit and are generally arranged so as to protect a plurality of wall sockets. Thus, when the total current in that circuit being drawn through all of the wall sockets combined exceeds a safe level, a circuit breaker will trip or the fuse will blow. Such a configuration, however, does not allow for protection for an appliance or the like attached to a single socket, since a fuse set to monitor overload from a plurality of sockets may be of too high a value to provide overload protection for a single appliance.

For the foregoing reason, many appliances are sold with their own internal fuse protection. However, there are many appliances which are not provided with such protection and it is desirable, in some circumstances to provide separate fuse protection for such appliances.

In the prior art, various designs exist for appliance plugs which contain internal fuses. This basic concept is disadvantageous, since it requires a fused plug for each appliance, substantially increasing costs. In addition, prior art devices of this type have typically incorporated the fuse within the plug housing, making replacement inconvenient and making it impossible to determine whether or not the fuse is blown without disassembly of the plug.

It has been proposed in the prior art to provide an adaptor which is fused to protect any appliance or the like plugged into the wall socket via the adaptor. This offers the advantage over fused plugs in that a single adaptor may be utilized to protect any appliance plugged into it. Prior art adaptors of this general type, however, have suffered from a number of disadvantages. For example, fuses have been contained within the adaptor housing, making replacement inconvenient and making it impossible to readily ascertain whether or not the fuse has been blown. Additionally, such adaptors have typically been easily removed from the wall socket, making it easy to inadvertently or intentionally bypass the adaptor.

It is an object of the present invention to provide an improved adaptor for an electrical AC wall socket for constituting a fused link between the wall socket and an electrical appliance or the like.

Another object of the invention is to provide a fused adaptor wherein replacement of a blown fuse is readily accomplished.

Another object of the invention is to provide a fused adaptor wherein it is easy to visually determine the existence of a blown fuse.

Another object of the invention is to provide a fused adaptor which prevents intentional or inadvertent bypassing.

Other objects of the invention will become apparent to those skilled in the art from the following description, taken in connection with the accompanying drawing wherein:

BRIEF DESCRIPTION OF THE DRAWING

FIG. 1 is a partially exploded view of an adaptor constructed in accordance with the invention and wherein the adaptor housing is unfolded to an open condition;

FIG. 2 is a perspective view illustrating how the adaptor of the invention may be utilized in connection with a typical wall socket; and FIG. 3 is a perspective view, with parts broken away, of a removable fuse housing assembly—a portion of the adaptor of FIGS. 1 and 2.

Very generally, the adaptor of the invention comprises an adaptor housing 10 from which first male connector means 11 extend. The first male connector means are adapted for mating with the wall socket for providing electrical connection therewith. First female connector means 12 in the adaptor housing are adapted for receiving an appliance plug or the like. Second female connector means 13 in the adaptor housing are disposed electrically between the first female connector means and the first male connector means and constitute at least one open circuit segment therebetween. A second male connector means 15, connected to fuse means 14, is adapted for mating with the second female connector for connecting the fuse means across the open circuit segment. The fuse means include a fuse link contained in a fuse housing which is removably received in a mating recess in the adaptor housing 10.

Referring now more particularly to FIG. 1, a preferred form of the invention is shown. In the device illustrated in FIG. 1, the adaptor includes the adaptor housing means indicated generally at 10 and which comprise a unitary piece of molded non-conductive plastic. The housing means 10 include a bottom wall 16 which forms, on one outer surface of the housing means 10, a substantially planar surface. An upper wall 17 includes a center portion of substantially flat configuration, which, with the housing assembled, is substantially parallel with the wall 16. The wall 17 also includes a pair of portions **17*a* and 17*b* which extend downwardly to intercept the side walls 18 and 19, respectively, of the housing means 10. A third wall 17*c* depends at one end from the wall 17 to intercept a shelf 21 which is substantially parallel with the plane of the wall 17. The side walls 18 and 19 intercept a roughly V-shaped end wall 23 which extends perpendicularly of the plane of the shelf 21 and forms one end of the housing means 10. A pair of recesses 25 and 27 are formed, respectively, in the side walls 18 and 19** for purposes which will be explained below.

The walls 16 and 17 are joined by a substantially planar wall 29. At the juncture between the wall 29 and the wall 17 is a fold line indicated by line 31. A similar fold line 33 exists between the wall 29 and the wall 16. The housing means 10 fold at the lines 31 and 33 so that the wall 29 forms an end wall for the housing which is opposite to the end wall 23. A recess 35 formed along the edge of the walls 18 and 19 mates with a complementary recess 37 formed along the upper edge of a short wall 39 extending around the periphery of the wall 16. Thus, when folded upon itself, the housing means 10 comprise a planar exterior surface on the underside of the wall 16 at one end of which is a perpendicular wall 29 and at the other end of which is a V-shaped wall 23 depending from the shelf 21 to form a recess by the exterior surfaces of the wall **17*c* and the shelf 21**.

For the purpose of securing the housing means 10 in the folded condition, screw posts 41 and 43 are molded integrally with the housing adjacent the V-shaped wall 23. These posts mate, respectively, with posts 45 and 47 molded integrally adjacent the end of the the wall 16. Suitable screws such as the one indicated at 49 may be used through threaded holes in the posts for securing the housing in its folded condition.

The first male connector means 11 extend from the housing 10 and comprise a pair of hot prongs 51, 52 and a ground prong 53 in a conventional male plug configuration. The prongs are supported in openings, not shown, in the housing 10 in the wall 16 thereof suitably secured therein by means, not shown. Any conventional means for securing such prongs in a housing may be utilized. The ground prong 53 is similarly secured in an opening in the wall 16.

The first female connector means 12 in the adaptor housing 10 comprise a pair of conductive contacts 55 and 56 suitably supported, by means not shown, on the wall 16 of the housing 10. In addition, the first female connector means 12 include a ground terminal 57 in the form of a horizontal bar supported on a mounting post 59 mounted integrally with the housing 10 and extending upwardly from the wall 16. For reasons which will be explained below, the post includes a central hole therein. When the housing 10 is folded up, the wall 29 is oriented perpendicularly of the wall 16 such that a pair of openings 61 align with the contacts 55 and 56 and such that a ground plug opening 63 aligns with the ground contact 57. The configuration of the respective contacts 55, 56 and 57 and the corresponding holes 61 and 63 are in a conventional configuration so as to receive a standard electrical appliance plug or the like.

The first male connector means 11 and the first female connector means 12 are electrically connected by second female connector means 13. In the preferred embodiment, the second female connector means include a female connector which forms an open circuit segment, in the AC path from the prong 51 of male connector means 11 and the contact 55 of the female connector means 12. To this end, the second female connector means include a female contact 65 and a female contact 67. The contact 65 is provided at the opposite end of the prong 51 and aligns with a horizontal slot formed by a notch 69 in the recess 27. The female contact 67 is formed at the opposite end of the female contact 55 and is aligned with the slot 73 formed in the notch 27. Thus, the female contacts 65 and 67 define an open circuit segment between the male prong 51 and the female contact 55.

The fuse means 14, as shown in FIGS. 2 and 3, plugs into the recess 27 on the side of the adaptor. A standard fuse link 75 is enclosed within a fuse housing 77 which has a transparent window 79 therein for viewing the condition of the fuse link 75. The second male connector means 15 protrude from the fuse housing 14 and consist of a pair of male prongs 81 and 83 for engaging the female contacts 65 and 67, respectively. The male prongs in the second male connector means 15 are oriented with respect to each other in mutually perpendicular planes, thus constituting a nonconventional socket configuration. This is also true of the slots 73 and 69 which therefore prevent inadvertent insertion of a conventional appliance plug or the like therein.

Referring now to FIG. 3, the fuse housing 77 is comprised of a rectangular box having a pair of parallel flanges 82 and 84 extending along opposite edges of an open side of the box or housing 77. Suitable strengthening ribs 86 are provided on the inner surface of the walls of the housing 77. The housing 77 is also provided with a pair of openings 88 and 89 at the edge of the sidewalls of the box 77 opposite the flanges 82 and 84. The open side of the box 77 is closed by the transparent window 79, which is secured in place by a pair of detent projections 90 and 92. The projections 90 and 92 form a latch in that each snaps within a respective one of the openings 88 and 89 to secure the transparent window 79 in place over the open side of the housing. The fuse link 75 is supported within the housing 77 by an electrically conductive cup 94 electrically connected to the prong 83, and by an electrically conductive collar 96 which is electrically connected to the prong 81. By viewing FIG. 2, it may be seen that, with the housing 77 in place, the detents 90 and 92 are positioned such as to be inaccessible. This effectively prevents removal of the transparent window 79 with consequent prevention of access to the fuse link 75 until the entire housing 77 is removed from the recess 27. As best seen in FIG. 3, even if conventional holes or slots are formed in opposite ends of housing 77 corresponding to where any instrument of small diameter or cross-section could be thrust into the hole at one end of housing 77 to eject the fuse through the hole in the opposite end of the housing 77 without removing transparent window 79, such holes would also be inaccessible with housing 77 in place in recess 27.

The fuse housing 77 mates with the respective recess 27 in the adaptor housing 10 when the second male connector means 15 are received by the second female connector means 13. With the fuse housing in place, the connection between the first male connector means 11 and the first female connector means 12 is complete, with the current carrying path being fused by the fuse link 75. In addition, a permanent unfused ground connection is maintained via a perpendicular leg 87 extending downwardly from the bar shaped contact 57 to engage the ground prong 53 on the first male connector means 11. The other hot leg 52, 56 of the connection is not fused.

Returning now to FIG. 2, a housing 99 is provided for insertion in the recess 25 on the opposite side of the adaptor from the recess 27. The housing 99 may be of any suitable construction and contains a pair of plastic prongs 101 and 103. The prongs 101 and 103 are for insertion into slots 107 and 105, respectively, provided in the adaptor housing in the recess 25. No electrical connection is provided by the prongs 101 and 103, but they are used only for purposes of mechanically securing the housing 99 in the recess 25. The housing 99 may be opened, by suitable means not shown, to permit removal of a spare fuse link 109 therein.

The post 59 serves as a means for mounting the housing 10 to a conventional electrical AC wall socket. In addition, there is provided a mounting post 91 molded integrally with the housing 10 and in alignment with a further mounting post 93 to provide an alternative point for mounting the adaptor to the wall socket. When the opening through the posts 91 and 93 is utilized, the adaptor may be mounted by a screw 95 on a conventional wall socket 127 in the mounting hole 128 having two outlets 129 and 131 so that the second outlet 101 is not covered by the adaptor housing. However, if the opening through the post 59 is utilized, the arrangement of the prongs 51 and 53 in the outlet 131 is such as to cause the adaptor housing to extend over the second unplugged outlet 129 to block it and prevent bypassing of the adaptor, as is shown in FIG. 2.

The adaptor of the invention, therefore, provides versatility in the manner in which it may be mounted to a wall socket so as to either enable use of the adjacent unplugged socket or such as to prevent its use and therefore prevent bypassing of the adaptor. The removable fuse may be selected to have a rating depending upon the particular use in which the adaptor is employed. The external mounting of the fuse enables ready replacement and also makes it possible to easily examine the fuse to ascertain if the fuse is blown. The construction of the adaptor is efficient and economical and provides for high reliability. As shown in the drawings, the adaptor has a single female connector designed to receive an appliance plug. It will be apparent to those skilled in the art, however, that the adaptor of the invention may be modified to include more than one of such female connectors.

It will also be apparent that the number and type of fuses used may vary as desired or needed. Furthermore, rather than holding a spare fuse, the second housing and the internal contacts of the adaptor may be designed to provide a second fuse link in the path between the female connector means 12 and the male connector means 11. Such a variant might include fuse links of two types, e.g. one fuse having a 10 A slow blow characteristic and a second fuse being a 20 A fast blow fuse.

It may be seen, therefore, that the invention provides an improved adaptor for an electrical AC wall socket. The adaptor provides a fuse link between the wall socket and an electrical appliance or the like, thereby obviating the need for individual fuses in the appliance or in the appliance plug, and providing an additional safety link in the electrical circuit.

Various modifications of the invention in addition to those shown and described herein will become apparent to those skilled in the art from the foregoing description and accompanying drawings. Such modifications are intended to fall within the scope of the appended claims.

What is claimed is:

1. An adaptor for an electrical AC wall socket for providing a fused link between the wall socket and an electrical appliance or the like, said adaptor comprising: an adaptor housing, first male connector means extending from said adaptor housing and being adapted for mating with the wall socket for providing electrical connection therewith, first female connector means in said adaptor housing and being adapted for receiving an appliance plug or the like, said adaptor housing having an externally accessible recess therein and including second female connector means in said recess of said adaptor housing disposed electrically between said first female connector means and said first male connector means and constituting at least one open circuit segment therebetween, fuse means including a fuse housing having a transparent window therein, means for removably mounting a fuse link in said fuse housing, said fuse link having a transparent cylindrical body, two metal end caps, one disposed on each end of said body, and a fuse conductor mounted inside said cylinder, said conductor creating an electrical link between said two metal end caps, said fuse housing being of a mating configuration with said recess in said adaptor housing to be received therein, said transparent window and transparent cylindrical body enabling said fuse conductor to be externally viewed when said adaptor is mated with said wall socket, and second male connector means connected to said fuse means, said second male connector means extending out from a surface of said fuse housing so as to mate with said second female connector means for connecting said fuse means across said open circuit segment when said fuse housing is received in said recess.

2. An adaptor according to claim 1 wherein the configuration of said second female connector means is non-conventional so as to prevent insertion of a conventional appliance plug therein.

3. An adaptor according to claim 1 wherein said adaptor housing means include a substantially planar surface on one side thereof, and means for mounting said adaptor housing means such that said substantially planar surface covers the wall socket.

4. An adaptor according to claim 3 wherein said mounting means permit orienting said adaptor housing means to cover a second wall socket adjacent the one into which said first male connector means is inserted.

5. An adaptor according to claim 1 wherein said adaptor housing means comprise a unitary molded body.

6. An adaptor for an electrical AC wall socket for providing a fused link between the wall socket and an electrical appliance or the like, said adaptor comprising: an adaptor housing, first male connector means extending from said adaptor housing and being adapted for mating with the wall socket for providing electrical connection therewith, first female connector means in said adaptor housing and being adapted for receiving an appliance plug or the like, said adaptor housing having a recess therein and including second female connector means in said recess of said adaptor housing disposed electrically between said first female connector means and said first male connector means and constituting at least one open circuit segment therebetween, fuse means including a fuse link enclosed in a fuse housing having a transparent window therein, said fuse housing being of a mating configuration with said recess in said adaptor housing to be received therein, said second male connector means connected to said fuse means, said second male connector means mating with said second female connector means for connecting said fuse means across said open circuit segment when said fuse housing is received in said recess, said fuse housing including a removable portion for permitting access to said fuse link for replacement, and further including latch means for latching said removable portion in place, said latch means being positioned to be inaccessible when said fuse housing is received in said recess.

7. An adaptor according to claim 1 wherein said second female connector means comprise a pair of open circuit segments, one in each AC path from the wall socket, and wherein said fuse means include a pair of fuse links, each extending across a respective one of said open circuit segments.

8. An adaptor according to claim 1 wherein the configuration of said second male connector means is non-conventional so as to prevent the insertion of said fuse means into a conventional wall socket.

9. An adaptor according to claim 8 wherein said second male connector means comprises first and second prongs mounted on said fuse housing, said first prong connected to one end cap of said fuse link, said second prong connected to the other of said end cap of said fuse link, said first and second prongs further being oriented with respect to each other in mutually perpendicular planes and extending perpendicularly out from said surface of said fuse housing.

10. An adaptor according to claim 1 wherein said adaptor housing includes a second externally accessible recess therein, a second fuse housing having a transparent window therein, means for removably mounting a second fuse link in said second fuse housing, said second fuse housing being of a mating configuration with said second recess in said adaptor housing to be received therein and means for securing said second fuse housing in said second recess.

11. An adaptor according to claim 1 further comprising means for preventing access to said fuse link when said fuse housing is received in said recess.

* * * * *